US008810491B2

(12) United States Patent
Wu et al.

(10) Patent No.: US 8,810,491 B2
(45) Date of Patent: Aug. 19, 2014

(54) LIQUID CRYSTAL DISPLAY WITH COLOR WASHOUT IMPROVEMENT AND METHOD OF DRIVING SAME

(75) Inventors: Yu-Ching Wu, Hsinchu (TW); Tien-Lun Ting, Hsinchu (TW); Kun-Cheng Tien, Hsinchu (TW); Chien-Huang Liao, Hsinchu (TW); Wen-Hao Hsu, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 238 days.

(21) Appl. No.: 13/277,475

(22) Filed: Oct. 20, 2011

(65) Prior Publication Data

US 2013/0100106 A1 Apr. 25, 2013

(51) Int. Cl.
*G09G 3/36* (2006.01)

(52) U.S. Cl.
USPC ..... 345/87; 345/212; 345/90; 345/92; 349/39; 349/143; 349/149

(58) Field of Classification Search
USPC ..... 345/87–89, 212; 349/39, 143, 148; 257/88
See application file for complete search history.

(56) References Cited

U.S. PATENT DOCUMENTS

| | | | | |
|---|---|---|---|---|
| 7,612,788 | B2 * | 11/2009 | Chang et al. | 345/690 |
| 8,259,245 | B2 * | 9/2012 | Kim et al. | 349/39 |
| 2007/0018927 | A1 * | 1/2007 | Kim | 345/92 |
| 2007/0120798 | A1 * | 5/2007 | Lee et al. | 345/92 |
| 2008/0012807 | A1 * | 1/2008 | Chiang et al. | 345/87 |
| 2008/0100553 | A1 | 5/2008 | Shen et al. | |
| 2010/0066934 | A1 * | 3/2010 | Kim et al. | 349/39 |
| 2011/0169018 | A1 * | 7/2011 | Hsiao et al. | 257/88 |

* cited by examiner

*Primary Examiner* — Amare Mengistu
*Assistant Examiner* — Gloryvid Figueroa-Gibson
(74) *Attorney, Agent, or Firm* — Morris, Manning & Martin, LLP; Tim Tingkang Xia, Esq.

(57) ABSTRACT

An LCD panel with color washout improvement. In one embodiment, the LCD panel includes a plurality of pixels spatially arranged in a matrix form, each pixel defined between a respective pair of scanning lines ($G_n$, $G_{n_CS}$) and two neighboring data lines $D_m$ and $D_{m+1}$, comprising a pixel electrode, a first transistor electrically coupled to the scanning lines $G_n$, the date line $D_m$ and the pixel electrode, and a second transistor electrically coupled to the scanning lines $G_{n_CS}$ and the pixel electrode such that when N pairs of scanning signals to the N pairs of scanning lines $\{G_n, G_{n_CS}\}$ and a plurality of data signals to the data lines, the pixel electrode of each pixel has a first voltage at the first duration of a frame period, and a second voltage at the second duration of the frame period, respectively. The first and second voltages are substantially different from each other.

15 Claims, 7 Drawing Sheets

LIQUID CRYSTAL DISPLAY WITH COLOR WASHOUT IMPROVEMENT AND METHOD OF DRIVING SAME

FIELD OF THE INVENTION

The present invention relates generally to a liquid crystal display (LCD), and more particularly to an LCD having an LCD panel with color washout improvement and method of driving same.

BACKGROUND OF THE INVENTION

Liquid crystal displays (LCDs) are commonly used as a display device because of its capability of displaying images with good quality while using little electrical power. An LCD apparatus includes an LCD panel formed with liquid crystal cells and pixel elements with each associating with a corresponding liquid crystal cell and having a liquid crystal (LC) capacitor and a storage capacitor, a thin film transistor (TFT) electrically coupled with the liquid crystal capacitor and the storage capacitor. These pixel elements are substantially arranged in the form of a matrix having a number of pixel rows and a number of pixel columns. Typically, scanning signals are sequentially applied to the number of pixel rows for sequentially turning on the pixel elements row-by-row. When a scanning signal is applied to a pixel row to turn on corresponding TFTs of the pixel elements of a pixel row, source signals (image signals) for the pixel row are simultaneously applied to the number of pixel columns so as to charge the corresponding liquid crystal capacitor and storage capacitor of the pixel row for aligning orientations of the corresponding liquid crystal cells associated with the pixel row to control light transmittance therethrough. By repeating the procedure for all pixel rows, all pixel elements are supplied with corresponding source signals of the image signal, thereby displaying the image signal thereon.

Liquid crystal molecules have a definite orientational alignment as a result of their long, thin shapes. The orientations of liquid crystal molecules in liquid crystal cells of an LCD panel play a crucial role in the transmittance of light therethrough. For example, in a twist nematic LCD, when the liquid crystal molecules are in its tilted orientation, light from the direction of incidence is subject to various different indexes of reflection. Since the functionality of LCDs is based on the birefringence effect, the transmittance of light will vary with different viewing angles. Due to such differences in light transmission, optimum viewing of an LCD is limited within a narrow viewing angle. The limited viewing angle of LCDs is one of the major disadvantages associated with the LCDs and is a major factor in restricting applications of the LCDs.

Therefore, a heretofore unaddressed need exists in the art to address the aforementioned deficiencies and inadequacies.

SUMMARY OF THE INVENTION

The present invention, in one aspect, relates to an LCD panel with color washout improvement. In one embodiment, the LCD panel includes N pairs of scanning lines, $\{G_n, G_{n_CS}\}$, n=1, 2, . . . , N, spatially arranged along a row direction, M data lines, $\{D_m\}$, m=1, 2, . . . , M, spatially arranged crossing the N pairs of scanning lines $\{G_n, G_{n_CS}\}$ along a column direction perpendicular to the row direction, and a plurality of pixels, {P(n,m)}, spatially arranged in the form of a matrix.

Each pixel P(n,m) is defined between a respective pair of scanning lines $(G_n, G_{n_CS})$ and two neighboring data lines $D_m$ and $D_{m+1}$, and has a main pixel electrode and a sub-pixel electrode, a first transistor T1 having a gate electrically connected to the scanning line $G_n$, a source electrically connected to the data lines $D_m$ and a drain electrically connected to the main pixel electrode, a second transistor T2 having a gate electrically connected to the scanning line $G_{n_CS}$, a source and a drain electrically connected to the sub-pixel electrode, a third transistor T3 having a gate electrically connected to the scanning line $G_n$, a source electrically connected to the data lines $D_m$ and a drain electrically connected to the source of the second transistor T2, a first liquid crystal (LC) capacitor, Clc1, and a first storage capacitor, Cst1, both electrically connected between the main pixel electrode and a common electrode in parallel, a second LC capacitor, Clc2, and a second storage capacitor, Cst2, both electrically connected between the sub-pixel electrode and the common electrode in parallel, a first coupling capacitor Cx1 electrically connected between the sub-pixel electrode and the drain of the third transistor T3, and a second coupling capacitor Cx2 electrically connected between the main pixel electrode and the drain of the third transistor T3. In one embodiment, each pixel P(n,m) further has a third coupling capacitor Cx3 electrically connected between the main pixel electrode and the sub-pixel electrode.

In operation, N pairs of scanning signals $\{g_n, g_{n_CS}\}$ are applied to the N pairs of scanning lines $\{G_n, G_{n_CS}\}$, and a plurality of data signals is applied to the M data lines $\{D_m\}$, respectively, where the N pairs of scanning signals $\{g_n, g_{n_CS}\}$ are configured such that each scanning signal $g_{n_CS}$ is delayed from the scanning signal $g_n$ by an half of a frame period, $T_{FP}/2$, so that the scanning signals $\{g_n\}$ are sequentially applied to the scanning lines $\{G_n\}$ at the first half of the frame period, and the scanning signals $\{g_{n_CS}\}$ are sequentially applied to the scanning lines $\{G_{n_CS}\}$ at the second half of the frame period, thereby causing the main pixel and sub-pixel electrodes of each pixel P(n,m) to have voltages $V_{1_main}(n,m)$ and $V_{1_sub}(n,m)$ at the first half of the frame period and $V_{2_main}(n,m)$ and $V_{2_sub}(n,m)$ at the second half of the frame period, respectively, where $V_{1_main}(n,m)$ and $V_{2_main}(n,m)$ are substantially the same, and $V_{1_sub}(n,m)$ and $V_{2_sub}(n,m)$ are substantially different from each other. $V_{1_main}(n,m)$ is corresponding to a data signal applied to the pixel P(n,m).

In one embodiment, $V_{1_main}(n,m)=V_{gamma}(n,m)$, $V_{1_sub}(n,m)=R1*V_{gamma}(n,m)$, and $V_{2_sub}(n,m)=R2*V_{gamma}(n,m)$, where $V_{gamma}(n,m)$ is a gray level voltage being associated with one frame of an image to be displayed on the pixel P(n,m), $0.5 \le R1 \le 0.95$, and $0.5 \le R2 \le 0.95$, R1 and R2 being a voltage coupling ratios.

In another aspect, the present invention relates to an LCD panel with color washout improvement. In one embodiment, the LCD panel includes N pairs of scanning lines, $\{G_n, G_{n_CS}\}$, n=1, 2, . . . , N, spatially arranged along a row direction, M data lines, $\{D_m\}$, m=1, 2, . . . , M, spatially arranged crossing the N pairs of scanning lines $\{G_n, G_{n_CS}\}$ along a column direction perpendicular to the row direction, and a plurality of pixels, {P(n,m)}, spatially arranged in the form of a matrix, each pixel P(n,m) defined between a respective pair of scanning lines $(G_n, G_{n_CS})$ and two neighboring data lines $D_m$ and $D_{m+1}$, and comprising a pixel electrode, a liquid crystal (LC) capacitor, Clc, and a storage capacitor, Cst, both electrically connected between the pixel electrode and a common electrode in parallel, and a first transistor, T1, having a gate electrically connected to the scanning line $G_n$, a source electrically connected to the data lines $D_m$ and a drain electrically connected to the pixel electrode, and a second transistor, T2, having a gate electrically connected to the scanning line $G_{n_CS}$, a source electrically connected to the pixel electrode and a drain, and a charge sharing capacitor Ccs, electrically connected between the drain of the second transistor T2 and the common electrode.

In operation, N pairs of scanning signals $\{g_n, g_{n_CS}\}$ are applied to the N pairs of scanning lines $\{G_n, G_{n_CS}\}$, and a plurality of data signals is applied to the M data lines $\{D_m\}$, respectively, where the N pairs of scanning signals $\{g_n, g_{n_CS}\}$ are configured such that each scanning signal $g_{n_CS}$ is delayed from the scanning signal $g_n$ by an half of a frame period, $T_{FP}/2$, so that the scanning signals $\{g_n\}$ are sequentially applied to the scanning lines $\{G_n\}$ at the first half of the frame period, and the scanning signals $\{g_{n_CS}\}$ are sequentially applied to the scanning lines $\{G_{n_CS}\}$ at the second half of the frame period, thereby causing the pixel electrode of each pixel P(n,m) to have a first voltage $V_1(n,m)$ at the first half of the frame period and a second voltage $V_2(n,m)$ at the second half of the frame period, respectively, where the first and second voltages $V_1(n,m)$ and $V_2(n,m)$ are substantially different from each other. The first voltage $V_1(n,m)$ is corresponding to a data signal applied to the pixel P(n,m).

In one embodiment, $V_1(n,m)=V_{gamma}(n,m)$, and $V_2(n,m)=R*V_{gamma}(n,m)$, where $V_{gamma}(n,m)$ is a gray level voltage being associated with one frame of an image to be displayed on the pixel P(n,m), and $0.5 \le R \le 0.95$, R being a voltage coupling ratio.

In yet another aspect, the present invention relates to an LCD panel with color washout improvement. In one embodiment, the LCD panel includes a plurality of pixels, {P(n,m)}, spatially arranged in the form of a matrix, n=1, 2, . . . , N, and m=1, 2, . . . , M, each pixel P(n,m) defined between a respective pair of scanning lines $(G_n, G_{n_CS})$ and two neighboring data lines $D_m$ and $D_{m+1}$ crossing the pair of scanning lines $(G_n, G_{n_CS})$, and comprising a pixel electrode, a first transistor, T1, electrically coupled to the scanning lines $G_n$, the date line $D_m$ and the pixel electrode, and a second transistor, T2, electrically coupled to the scanning lines $G_{n_CS}$ and the pixel electrode.

In operation, a pair of scanning signals $(g_n, g_{n_CS})$ is applied to the pair of scanning lines $(G_n, G_{n_CS})$ to sequentially turn on the first and second transistors T1 and T2, a data signal is applied to the data line $D_m$ to charge the pixel electrode, where the scanning signal $g_{n_CS}$ is delayed from the scanning signal $g_n$ by time $T_D$, so that the pixel electrode of the pixel P(n,m) has a first voltage $V_1(n,m)$ at the time t when the first transistor T1 is turned on and a second voltage $V_2(n,m)$ at the time $(t+T_D)$ when the second transistor T2 is turned on, respectively, where the first and second voltages $V_1(n,m)$ and $V_2(n,m)$ are substantially different from each other, where $0.1*T_{FP} \le T_D \le 0.9*T_{FP}$, $T_{FP}$ being a frame period.

In one embodiment, each pixel P(n,m) further includes a liquid crystal (LC) capacitor, Clc, and a storage capacitor, Cst, both electrically connected between the pixel electrode and a common electrode in parallel, and a charge sharing capacitor Ccs, where the first transistor T1 has a gate electrically connected to the scanning line $G_n$, a source electrically connected to the data lines $D_m$ and a drain electrically connected to the pixel electrode, and the second transistor T2 has a gate electrically connected to the scanning line $G_{n_CS}$, a source electrically connected to the pixel electrode and a drain electrically connected to the charge sharing capacitor Ccs that in turn is electrically connected to the common electrode.

In one embodiment, the first voltage $V_1(n,m)$ is corresponding to a data signal applied to the pixel P(n,m). $V_1(n,m)=V_{gamma}(n,m)$, and $V_2(n,m)=R*V_{gamma}(n,m)$, where $V_{gamma}(n,m)$ is a gray level voltage being associated with one frame of an image to be displayed on the pixel P(n,m), and $0.5 \le R \le 0.95$, R being a voltage coupling ratio.

In one embodiment, the pixel electrode comprises a main pixel electrode and a sub-pixel electrode. Each pixel P(n,m) further includes a first liquid crystal (LC) capacitor, Clc1, and a first storage capacitor, Cst1, both electrically connected between the main pixel electrode and a common electrode in parallel, a second LC capacitor, Clc2, and a second storage capacitor, Cst2, both electrically connected between the sub-pixel electrode and the common electrode in parallel, a third transistor T3 having a gate electrically connected to the scanning line $G_n$, a source electrically connected to the data lines $D_m$ and a drain, a first coupling capacitor Cx1 electrically connected between the sub-pixel electrode and the drain of the third transistor T3, and a second coupling capacitor Cx2 electrically connected between the main pixel electrode and the drain of the third transistor T3. In one embodiment, each pixel P(n,m) further comprises a third coupling capacitor Cx3 electrically connected between the main pixel electrode and the sub-pixel electrode.

The first transistor T1 has a gate electrically connected to the scanning line $G_n$, a source electrically connected to the data lines $D_m$ and a drain electrically connected to the main pixel electrode, and the second transistor T2 has a gate electrically connected to the scanning line $G_{n_CS}$, a source electrically connected to the drain of the third transistor T3 and a drain electrically connected to the sub-pixel electrode.

In one embodiment, the first voltage $V_1(n,m)$ of the pixel electrode comprises a voltage $V_{1_main}(n,m)$ of the main pixel electrode, and a voltage $V_{1_sub}(n,m)$ of the sub-pixel electrode, and the second voltage $V_2(n,m)$ of the pixel electrode is characterized with a voltage $V_{2_main}(n,m)$ of the main pixel electrode, and a voltage $V_{2_sub}(n,m)$ of the sub-pixel electrode. $V_{1_main}(n,m)$ is corresponding to a data signal applied to the pixel P(n,m). In one embodiment, $V_{1_main}(n,m)=V_{gamma}(n,m)$, $V_{1_sub}(n,m)=R1*V_{gamma}(n,m)$, and $V_{2_sub}(n,m)=R2*V_{gamma}(n,m)$, where $V_{gamma}(n,m)$ is a gray level voltage being associated with one frame of an image to be displayed on the pixel P(n,m), $0.5 \le R1 \le 0.95$, and $0.5 \le R2 \le 0.95$, R1 and R2 being voltage coupling ratios.

In a further aspect, the present invention relates to a method of driving a liquid crystal display (LCD) with color washout improvement. In one embodiment, the method includes the steps of: providing an LCD panel comprising a plurality of pixels, {P(n,m)}, spatially arranged in the form of a matrix, n=1, 2, . . . , N, and m=1, 2, . . . , M, each pixel P(n,m) defined between a respective pair of scanning lines $(G_n, G_{n_CS})$ and two neighboring data lines $D_m$ and $D_{m+1}$ crossing the pair of scanning lines $(G_n, G_{n_CS})$, and comprising a pixel electrode, a first transistor, T1, electrically coupled to the scanning lines $G_n$, the date line $D_m$ and the pixel electrode, and a second transistor, T2, electrically coupled to the scanning lines $G_{n_CS}$ and the pixel electrode, and applying N pairs of scanning signals $\{g_n, g_{n_CS}\}$ to the N pairs of scanning lines $\{G_n, G_{n_CS}\}$ and a plurality of data signals to the M data lines $\{D_m\}$, respectively, so as to cause the pixel electrode of each pixel P(n,m) to have a first voltage $V_1(n,m)$ at the first duration of a frame period, $T_{FP}$, and a second voltage $V_2(n,m)$ at the second duration of the frame period $T_{FP}$, respectively, where the first and second voltages $V_1(n,m)$ and $V_2(n,m)$ are substantially different from each other.

In one embodiment, the N pairs of scanning signals $\{g_n, g_{n_CS}\}$ are configured such that each scanning signal $g_{n_CS}$ is delayed from the scanning signal $g_n$ by time $T_D$, so that the scanning signals $\{g_n\}$ are sequentially applied to the scanning lines $\{G_n\}$ at the first duration of the frame period, and the scanning signals $\{g_{n_CS}\}$ are sequentially applied to the scanning lines $\{G_{n_CS}\}$ at the second duration of the frame period, where the first duration is corresponding to the delayed time $T_D$, where $0.1*T_{FP} \leq T_D \leq 0.9*T_{FP}$.

In one embodiment, each pixel P(n,m) further comprises a liquid crystal (LC) capacitor, Clc, and a storage capacitor, Cst, both electrically connected between the pixel electrode and a common electrode in parallel, and a charge sharing capacitor Ccs, where the first transistor T1 has a gate electrically connected to the scanning line $G_n$, a source electrically connected to the data lines $D_m$ and a drain electrically connected to the pixel electrode, and the second transistor T2 has a gate electrically connected to the scanning line $G_{n_CS}$, a source electrically connected to the pixel electrode and a drain electrically connected to the charge sharing capacitor Ccs that in turn is electrically connected to the common electrode. The first voltage $V_1(n,m)$ is corresponding to a data signal applied to the pixel P(n,m). $V_1(n,m)=V_{gamma}(n,m)$, and $V_2(n,m)=R*V_{gamma}(n,m)$, where $V_{gamma}(n,m)$ is a gray level voltage being associated with one frame of an image to be displayed on the pixel P(n,m), and $0.5 \leq R \leq 0.95$, R being a voltage coupling ratio.

In another embodiment, the pixel electrode comprises a main pixel electrode and a sub-pixel electrode. Each pixel P(n,m) further comprises a first liquid crystal (LC) capacitor, Clc1, and a first storage capacitor, Cst1, both electrically connected between the main pixel electrode and a common electrode in parallel, a second LC capacitor, Clc2, and a second storage capacitor, Cst2, both electrically connected between the sub-pixel electrode and the common electrode in parallel, a third transistor T3 having a gate electrically connected to the scanning line $G_n$, a source electrically connected to the data lines $D_m$ and a drain, a first coupling capacitor Cx1 electrically connected between the sub-pixel electrode and the drain of the third transistor T3, a second coupling capacitor Cx2 electrically connected between the main pixel electrode and the drain of the third transistor T3, and a third coupling capacitor Cx3 electrically connected between the main pixel electrode and the sub-pixel electrode. The first transistor T1 has a gate electrically connected to the scanning line $G_n$, a source electrically connected to the data lines $D_m$ and a drain electrically connected to the main pixel electrode, and the second transistor T2 has a gate electrically connected to the scanning line $G_{n_CS}$, a source electrically connected to the drain of the third transistor T3 and a drain electrically connected to the sub-pixel electrode.

In one embodiment, the first voltage $V_1(n,m)$ of the pixel electrode comprises a voltage $V_{1_main}(n,m)$ of the main pixel electrode, and a voltage $V_{1_sub}(n,m)$ of the sub-pixel electrode, and the second voltage $V_2(n,m)$ of the pixel electrode is characterized with a voltage $V_{2_main}(n,m)$ of the main pixel electrode, and a voltage $V_{2_sub}(n,m)$ of the sub-pixel electrode. $V_{1_main}(n,m)$ is corresponding to a data signal applied to the pixel P(n,m). $V_{1_main}(n,m)=V_{gamma}(n,m)$, $V_{1_sub}(n,m)=R1*V_{gamma}(n,m)$, and $V_{2_sub}(n,m)=R2*V_{gamma}(n,m)$, where $V_{gamma}(n,m)$ is a gray level voltage being associated with one frame of an image to be displayed on the pixel P(n,m), $0.5 \leq R1 \leq 0.95$, and $0.5 \leq R2 \leq 0.95$, R1 and R2 being voltage coupling ratios.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
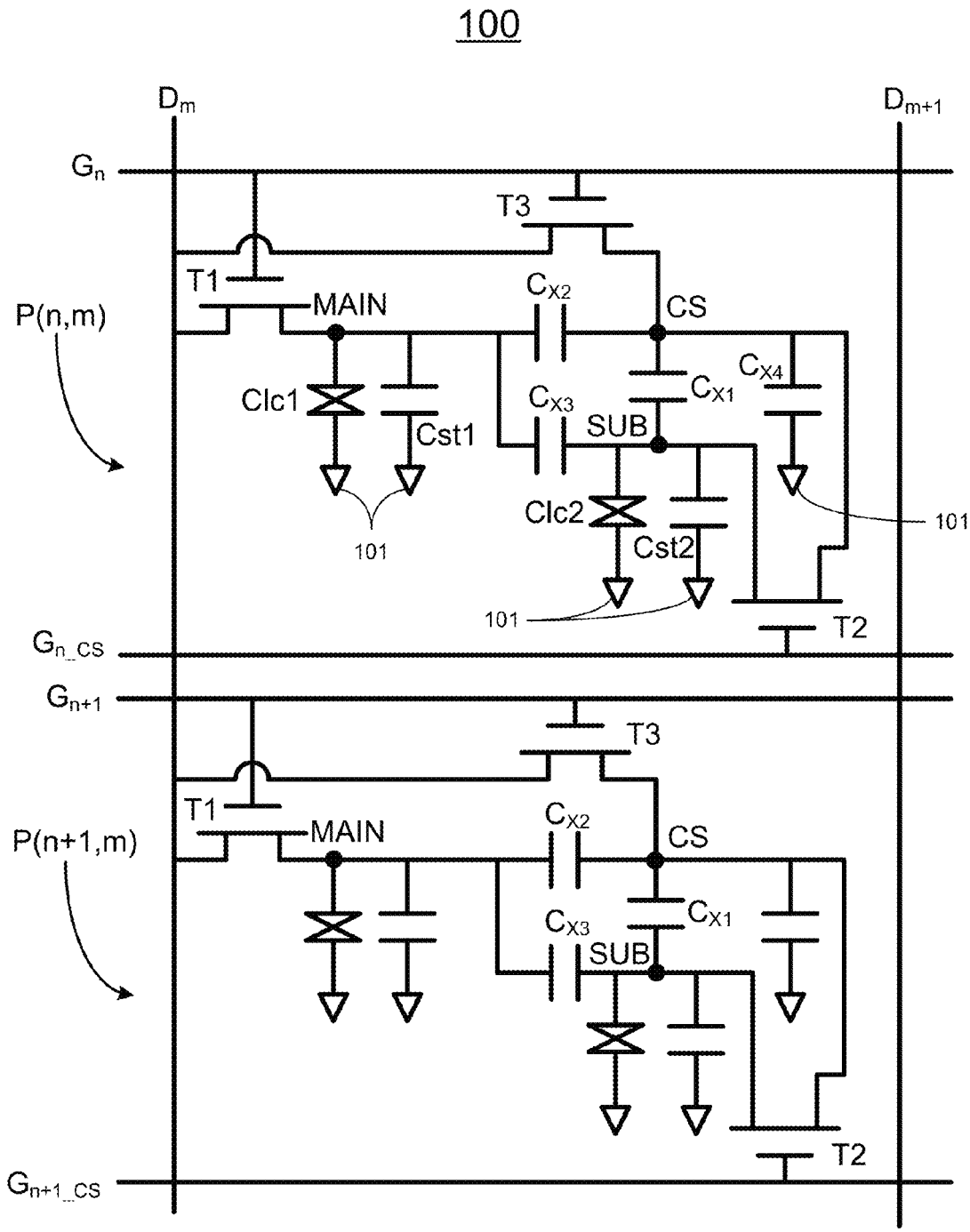
FIG. 1 partially shows schematically an equivalent circuit diagram of an LCD panel according to one embodiment of the present invention.

The present disclosure is more particularly described in the following examples that are intended as illustrative only since numerous modifications and variations therein will be apparent to those skilled in the art. Various embodiments of the disclosure are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. The use of examples anywhere in this specification, including examples of any terms discussed herein, is illustrative only, and in no way limits the scope and meaning of the disclosure or of any exemplified term. Likewise, the disclosure is not limited to various embodiments given in this specification.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "having," "containing," "involving," and the like are to be understood to be open-ended, i.e., to mean including but not limited to.

As used herein, the terms "gamma" and/or "gamma curve" refer to the characterization of brightness of an imaging display system, for example, an LCD device, versus grey levels (scales). Gamma summarizes, in a single numerical parameter, the nonlinear relationship between grey level and brightness of the imaging display system.

As used herein, the term "grey level voltage", "gamma voltage" or "driving voltage" refers to a voltage generated from a data driver in accordance for driving a particular area or pixel of an LCD panel, in accordance with a grey level of a frame of an image to be displayed at the particular area or pixel of the LCD panel.

The description will be made as to the embodiments of the present invention in conjunction with the accompanying drawings in FIGS. 1-7. In accordance with the purposes of this invention, as embodied and broadly described herein, this invention, in one aspect, relates to an LCD panel with color washout improvement.

Referring to FIG. 1, an LCD panel 100 according to one embodiment of the present invention is partially and schematically shown. The LCD panel 100 includes a common electrode 101, N pairs of scanning lines, $\{G_n, G_{n_CS}\}$, n=1, 2, . . . , N, spatially arranged along a row direction, M data lines, $\{D_m\}$, m=1, 2, . . . , M, spatially arranged crossing the N pairs of scanning lines $\{G_n, G_{n_CS}\}$ along a column direction perpendicular to the row direction, and a plurality of pixels, {P(n,m)}, spatially arranged in the form of a matrix. Each pixel P(n,m) is defined between a respective pair of scanning lines $(G_n, G_{n_CS})$ and two neighboring data lines $D_m$ and $D_{m+1}$. For the purpose of illustration of embodiments of the present invention, FIG. 1 schematically shows only two pairs of scanning lines $(G_n, G_{n_CS})$ and $(G_{n+1}, G_{n+1_CS})$, two neighboring data lines $D_m$ and $D_{m+1}$, and two corresponding pixels P(n,m) and P(n+1,m) of the LCD panel 100.

Each pixel P(n,m) is configured to have a main pixel electrode, MAIN, and a sub-pixel electrode, SUB, a first transistor T1 having a gate electrically connected to the scanning line $G_n$, a source electrically connected to the data lines $D_m$ and a drain electrically connected to the main pixel electrode MAIN, a second transistor T2 having a gate electrically connected to the scanning line $G_{n_CS}$, a source and a drain electrically connected to the sub-pixel electrode SUB, a third transistor T3 having a gate electrically connected to the scanning line $G_n$, a source electrically connected to the data lines $D_m$ and a drain electrically connected to the source of the second transistor T2, a first LC capacitor Clc1 and a first storage capacitor Cst1 both electrically connected between the main pixel electrode MAIN and the common electrode 101 in parallel, and a second LC capacitor Clc2 and a second storage capacitor Cst2 both electrically connected between the sub-pixel electrode SUB and the common electrode 101 in parallel.

Each pixel P(n,m) also has a first coupling capacitor Cx1 electrically connected between the sub-pixel electrode (SUB) and the drain of the third transistor T3, a second coupling capacitor Cx2 electrically connected between the main pixel electrode (MAIN) and the drain of the third transistor T3, and a third coupling capacitor Cx3 electrically connected between the main pixel electrode and the sub-pixel electrode. The first coupling capacitor Cx1 is adapted to improve the washout performance. The second coupling capacitor Cx2 is resulted from the layout process, and is unavoidable but has disadvantages in the color washout improvement. However, the third coupling capacitor Cx3 is adapted to overcome the disadvantages of the second coupling capacitor Cx2.

Additionally, each pixel P(n,m) may also include a fourth coupling capacitor Cx4, which offers an additional degree of freedom to design the preferred relationship between the charge sharing voltage $V_{CS}$ and the sub-pixel electrode voltage $V_{SUB}$.

For such an LCD 100, when N pairs of scanning signals $\{g_n, g_{n_CS}\}$ are applied to the N pairs of scanning lines $\{G_n, G_{n_CS}\}$, and a plurality of data signals is applied to the M data lines $\{D_m\}$, respectively, the main pixel and sub-pixel electrodes of each pixel P(n,m) have different voltages at a first half of a frame period, $T_{FP}$, that are substantially different from those at the second half of the frame period $T_{FP}$, so as to improve the color washout. The frame period $T_{FP}$ is a time duration of scanning the N pairs of scanning lines $\{G_n, G_{n_CS}\}$ for displaying a frame of an image.

Figure 2:
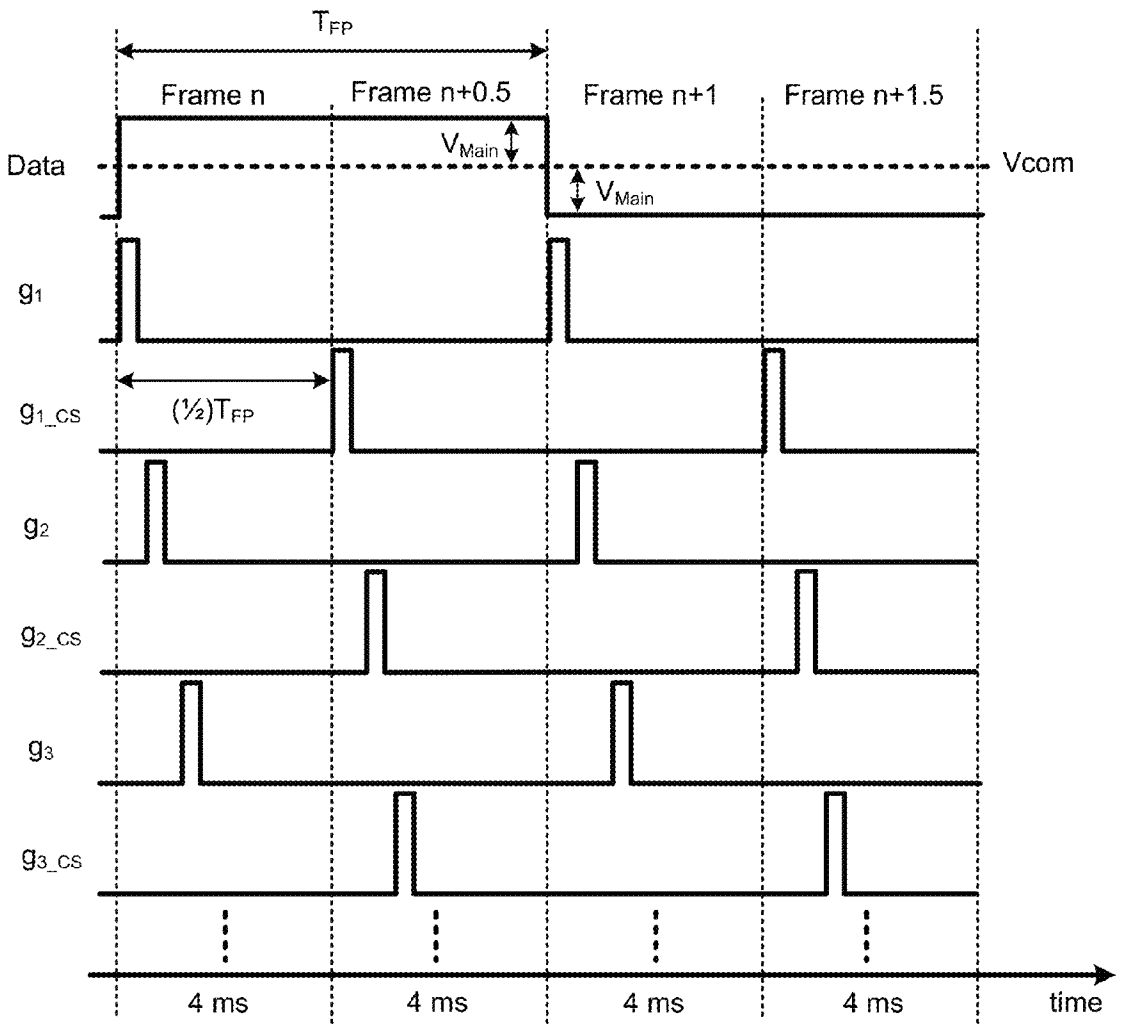
FIG. 2 shows schematically waveform charts of driving signals applied to an LCD panel according to one embodiment of the present invention.

Specifically, the N pairs of scanning signals $\{g_n, g_{n_CS}\}$ are configured such that each scanning signal $g_{n_CS}$ is delayed from the scanning signal $g_n$ by an half of the frame period, $T_{FP}/2$, so that the scanning signals $\{g_n\}$ are sequentially applied to the scanning lines $\{G_n\}$ at the first half of the frame period, and the scanning signals $\{g_{n_CS}\}$ are sequentially applied to the scanning lines $\{G_{n_CS}\}$ at the second half of the frame period, as shown in FIG. 2, where only three pairs of the scanning signals $(g_1, g_{1\ CS})$, $(g_2, g_{2\ CS})$, and $(g_3, g_{3\ CS})$ are shown.

In other words, each frame period is divided into two periods (or durations). At the first period, the scanning signals $\{g_n\}$ are sequentially applied to the scanning lines $\{G_n\}$ to turn on the first and third transistors T1 and T3 of each pixel row, respectively, and data signals of a frame of an image are applied to the M data lines $\{D_m\}$ to charge the main pixel and sub-pixel electrodes of each pixel P(n,m). As a results, the main pixel of each pixel P(n,m) is charged by a respective one of the data signals to have a voltage $V_{1_main}(n,m)$, while the sub-pixel electrode of each pixel P(n,m) is charged by charge sharing to have a voltage $V_{1_sub}(n,m)$. The main pixel electrode voltage $V_{1_main}(n,m)=V_{gamma}(n,m)$, where $V_{gamma}(n,m)$ is a gray level voltage being associated with the frame of the image to be displayed on the pixel P(n,m). In practice, the gray level voltage $V_{gamma}(n,m)$ is calculated based on a desired gamma curve of the LCD panel and frame data of the image to be displayed, and stored in a look-up table (LUT). Further, the sub-pixel electrode voltage $V_{1_sub}(n,m)=R1*V_{gamma}(n,m)$, where $0.5 \le R1 \le 0.95$, R1 being a voltage coupling ratio that is determined by the capacitance of the first coupling capacitor Cx1.

At the second period, the scanning signals $\{g_{n_CS}\}$ are sequentially applied to the scanning lines $\{G_{n_CS}\}$ to turn on the second transistor T2 of each pixel row, respectively. However, no data signals applied to the M data lines $\{D_m\}$ are input to any pixel. Accordingly, the main pixel of each pixel P(n,m) has a voltage $V_{2_main}(n,m)$, and the sub-pixel electrode of each pixel P(n,m) has a voltage $V_{2_sub}(n,m)$. $V_{1_main}(n,m)$ and $V_{2_main}(n,m)$ are substantially the same, and $V_{1_sub}(n,m)$ and $V_{2_sub}(n,m)$ are substantially different from each other. $V_{2\ sub}(n,m)=R2*V_{gamma}(n,m)$, where $0.5 \le R2 \le 0.95$, R2 being a voltage coupling ratio.

Accordingly, for each frame of an image display, there are four different brightnesses achieved in each pixel, which makes the gamma curve of the LCD panel 100 is much close to gamma 2.2, compared with the conventional two sub-pixel design, and therefore improves the color washout of the LCD. The pixel design and the driving configuration according to the present invention extend effectively the image display from conventional 8 domains to 12 domains.

In the embodiment shown in FIG. 2, each scanning signal $g_{n_CS}$ is delayed from the scanning signal $g_n$ by the half of the frame period $T_{FP}/2$. Other delaying arrangements can also be utilized to practice the present invention. For example, in another embodiment, each scanning signal $g_{n_CS}$ is delayed from the scanning signal $g_n$ by time $T_D$, so that the scanning signals $\{g_n\}$ are sequentially applied to the scanning lines $\{G_n\}$ at the first duration of the frame period, and the scanning signals $\{g_{n_CS}\}$ are sequentially applied to the scanning lines $\{G_{n_CS}\}$ at the second duration of the frame period, where the first duration is corresponding to the delayed time $T_D$, where $0.1*T_{FP} \leq T_D \leq 0.9*T_{FP}$.

Figure 3:
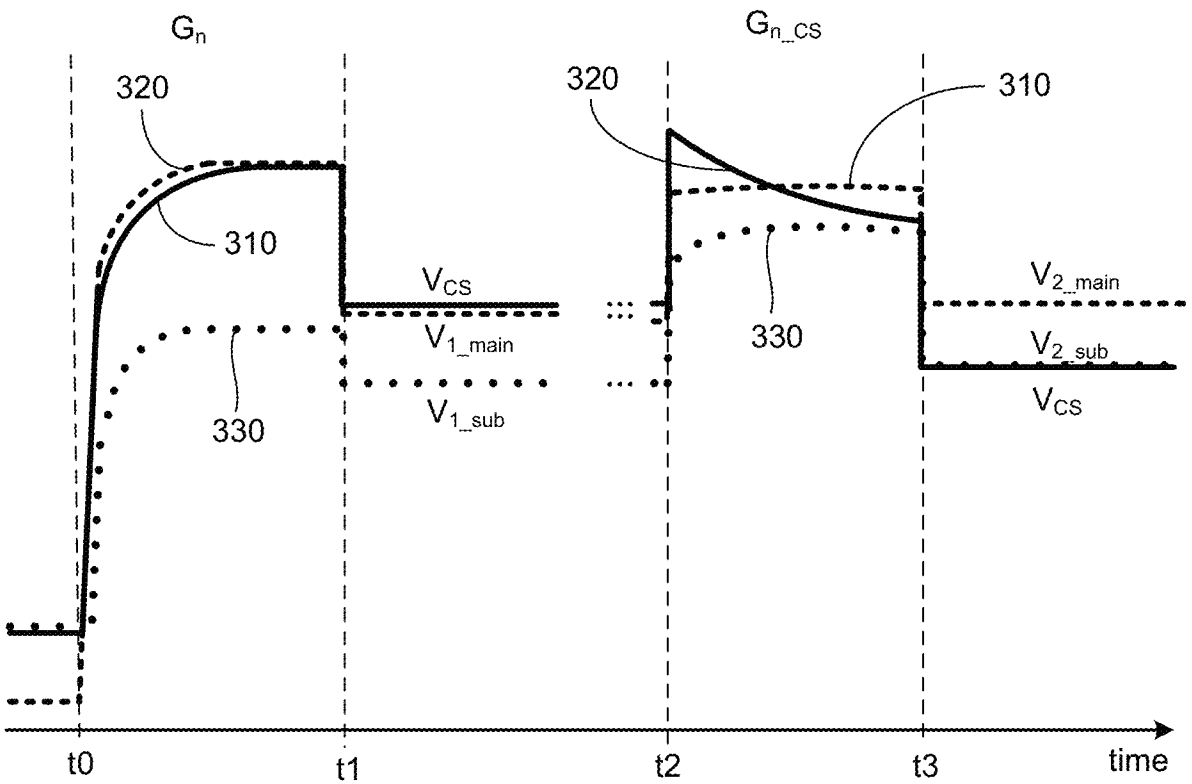
FIG. 3 shows schematically voltages generated in each pixel of an LCD panel according to one embodiment of the present invention.

Referring to FIG. 3, voltages generated in each pixel of the LCD panel 100 shown in FIG. 1 are shown according to one embodiment of the present invention. When a scanning signal $g_n$ (high voltage pulse) is applied to the scanning line $G_n$ at time t0, to turn on the first and third transistors T1 and T3, an image data signal is input to the pixels connected to the scanning line $G_n$. Accordingly, the voltage $V_{1_Main}$ 310 of the main pixel electrode (MAIN) is increased. On the other hand, the image data is also written, through the third transistor T3, into the CS node. In the case, the voltage $V_{CS}$ 320 of the CS node and the voltage $V_{1_Main}$ 310 of the main pixel electrode are the same. In addition, because of the first coupling capacitor Cx1 electrically connected between the CS node and the sub-pixel electrode (SUB), the voltage $V_{1_Sub}$ 330 of the sub-pixel electrode is also increased. When no high voltage pulse is applied to the scanning line $G_n$ at time t1, the voltage $V_{CS}$ 320 of the CS node, the voltage $V_{1_Main}$ 310 of the main pixel electrode MAIN and the voltage $V_{1_Sub}$ 330 of the sub-pixel electrode SUB are slightly reduced because of the feed through effect.

Sequentially, when a scanning signal $g_{n_CS}$ (high voltage pulse) is applied to the scanning line $G_{n_CS}$ at time t2, the voltage $V_{CS}$ 320 of the CS node, the voltage $V_{1_Main}$ 310 of the main pixel electrode and the voltage $V_{1_Sub}$ 330 of the sub-pixel electrode SUB increase accordingly, because of the application of the scanning signal $g_{n_CS}$ (switch voltage). On the other hand, the second transistor T2 is turned on, which makes the CS node and the sub-pixel electrode be electrical conducted. Under the redistribution of the electrical charges, the voltage $V_{CS}$ 320 of the CS node decrease, while the voltage $V_{2_Sub}$ 330 of the sub-pixel electrode increases gradually up to the voltage $V_{CS}$ 320 of the CS node is actually equal to the voltage $V_{2_Sub}$ 330 of the sub-pixel electrode SUB. Finally, when no high voltage pulse is applied to the scanning line $G_{n_CS}$ at time t3, the voltage $V_{2_Main}$ 310 of the main pixel electrode and the voltage $V_{2_Sub}$ 330 of the sub-pixel electrode are slightly reduced because of the feed through effect, but are substantially different from each other.

Therefore, for such a pixel design, by utilizing the coupling effect of the first coupling capacitor Cx1, different voltages at the main pixel and sub-pixel electrodes can be achieved in each frame of an image display, thereby improving the color washout.

Figure 4:
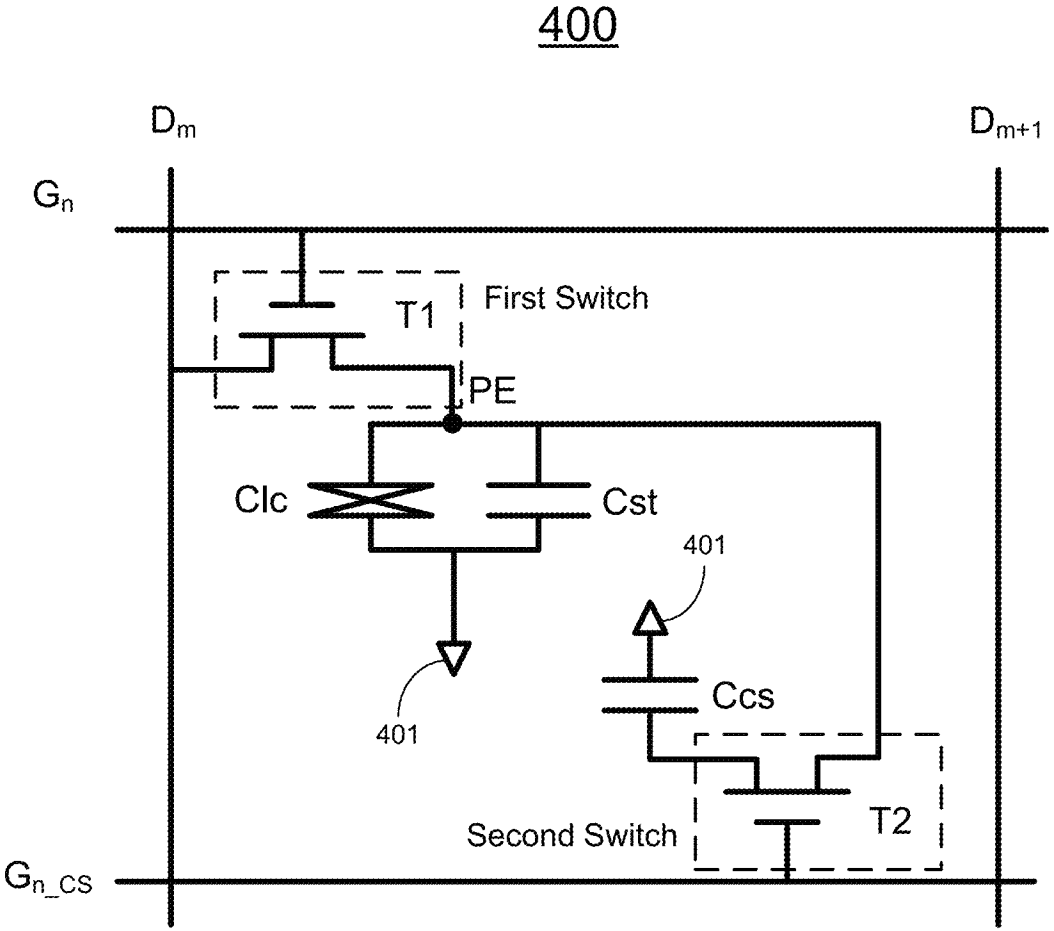
FIG. 4 shows schematically an equivalent circuit diagram of an LCD panel according to another embodiment of the present invention.

Referring to FIG. 4, an LCD panel 400 according to another embodiment of the present invention is partially and schematically shown. Similarly, the LCD panel 400 includes N pairs of scanning lines, $\{G_n, G_{n_CS}\}$, n=1, 2, . . . , N, spatially arranged along a row direction, M data lines, $\{D_m\}$, m=1, 2, . . . , M, spatially arranged crossing the N pairs of scanning lines $\{G_n, G_{n_CS}\}$ along a column direction perpendicular to the row direction, and a plurality of pixels, {P(n, m)}, spatially arranged in the form of a matrix. Each pixel P(n,m) is defined between a respective pair of scanning lines $(G_n, G_{n_CS})$ and two neighboring data lines $D_m$ and $D_{m+1}$.

In addition, each pixel P(n,m) includes a pixel electrode (PE), an LC capacitor Clc and a storage capacitor Cst both electrically connected between the pixel electrode and a common electrode 401 in parallel, and a first transistor T1 having a gate electrically connected to the scanning line $G_n$, a source electrically connected to the data lines $D_m$ and a drain electrically connected to the pixel electrode, and a second transistor T2 having a gate electrically connected to the scanning line $G_{n_CS}$, a source electrically connected to the pixel electrode and a drain, and a charge sharing capacitor Ccs, electrically connected between the drain of the second transistor T2 and the common electrode 401.

In operation, N pairs of scanning signals $\{g_n, g_{n_CS}\}$ are applied to the N pairs of scanning lines $\{G_n, G_{n_CS}\}$, and a plurality of data signals is applied to the M data lines $\{D_m\}$, respectively. According to the embodiment of the present invention shown in FIG. 4, different voltages at the pixel electrode of each pixel P(n,m) for the first half of the frame period and the second half of the frame period can be obtained so as to improve the color washout.

In one embodiment, the N pairs of scanning signals $\{g_n, g_{n_CS}\}$ are configured such that each scanning signal $g_{n_CS}$ is delayed from the scanning signal $g_n$ by an half of a frame period, $T_{FP}/2$, so that the scanning signals $\{g_n\}$ are sequentially applied to the scanning lines $\{G_n\}$ at the first half of the frame period, and the scanning signals $\{g_{n_CS}\}$ are sequentially applied to the scanning lines $\{G_{n_CS}\}$ at the second half of the frame period, thereby causing the pixel electrode of each pixel P(n,m) to have a first voltage $V_1$(n,m) at the first half of the frame period and a second voltage $V_2$(n,m) at the second half of the frame period, respectively, where the first and second voltages $V_1$(n,m) and $V_2$(n,m) are substantially different from each other. The first voltage $V_1(n,m)=V_{gamma}(n,m)$ and is corresponding to a data signal applied to the pixel P(n,m). The second voltage $V_2(n,m)=R*V_{gamma}(n,m)$, where $0.5 \leq R \leq 0.95$, R being a voltage coupling ratio.

In another embodiment, each scanning signal $g_{n_CS}$ is delayed from the scanning signal $g_n$ by time $T_D$, so that the scanning signals $\{g_n\}$ are sequentially applied to the scanning lines $\{G_n\}$ at the first duration of the frame period, and the scanning signals $\{g_{n_CS}\}$ are sequentially applied to the scanning lines $\{G_{n_CS}\}$ at the second duration of the frame period, where the first duration is corresponding to the delayed time $T_D$, where $0.1*T_{FP} \leq T_D \leq 0.9*T_{FP}$.

Accordingly, for each frame of an image display, there are two different brightnesses achieved in each pixel, which makes the gamma curve of the LCD panel 400 is much close to gamma 2.2, compared with the conventional one pixel design, and therefore improves the color washout of the LCD. The pixel design and the driving configuration according to the present invention extend effectively the image display from conventional 4 domains to 8 domains.

In one aspect of the present invention, an LCD panel includes a plurality of pixels, {P(n,m)}, spatially arranged in the form of a matrix, n=1, 2, . . . , N, and m=1, 2, . . . , M, each pixel P(n,m) defined between a respective pair of scanning lines $(G_n, G_{n_CS})$ and two neighboring data lines $D_m$ and $D_{m+1}$ crossing the pair of scanning lines $(G_n, G_{n_CS})$, and comprising a pixel electrode, a first transistor, T1, electrically coupled to the scanning lines $G_n$, the date line $D_m$ and the pixel electrode, and a second transistor, T2, electrically coupled to the scanning lines $G_{n_CS}$ and the pixel electrode. Each pixel P(n,m) can be a pixel defined in FIG. 1 or defined in FIG. 4, or the like.

When a pair of scanning signals $(g_n, g_{n_CS})$ is applied to the pair of scanning lines $(G_n, G_{n_CS})$ to sequentially turn on the first and second transistors T1 and T2, a data signal is applied to the data line $D_m$ to charge the pixel electrode so as to achieve different voltages of the pixel electrode at different times of a frame period. The scanning signal $g_{n_CS}$ is delayed from the scanning signal $g_n$ by time $T_D$, so that the pixel electrode of the pixel P(n,m) has a first voltage $V_1$(n,m) at the time t when the first transistor T1 is turned on and a second voltage $V_2(n,m)$ at the time $(t+T_D)$ when the second transistor T2 is turned on, respectively, where the first and second voltages $V_1(n,m)$ and $V_2(n,m)$ are substantially different from each other, where $0.1*T_{FP} \leq T_D \leq 0.9*T_{FP}$, $T_{FP}$ being a frame period.

Figure 5:
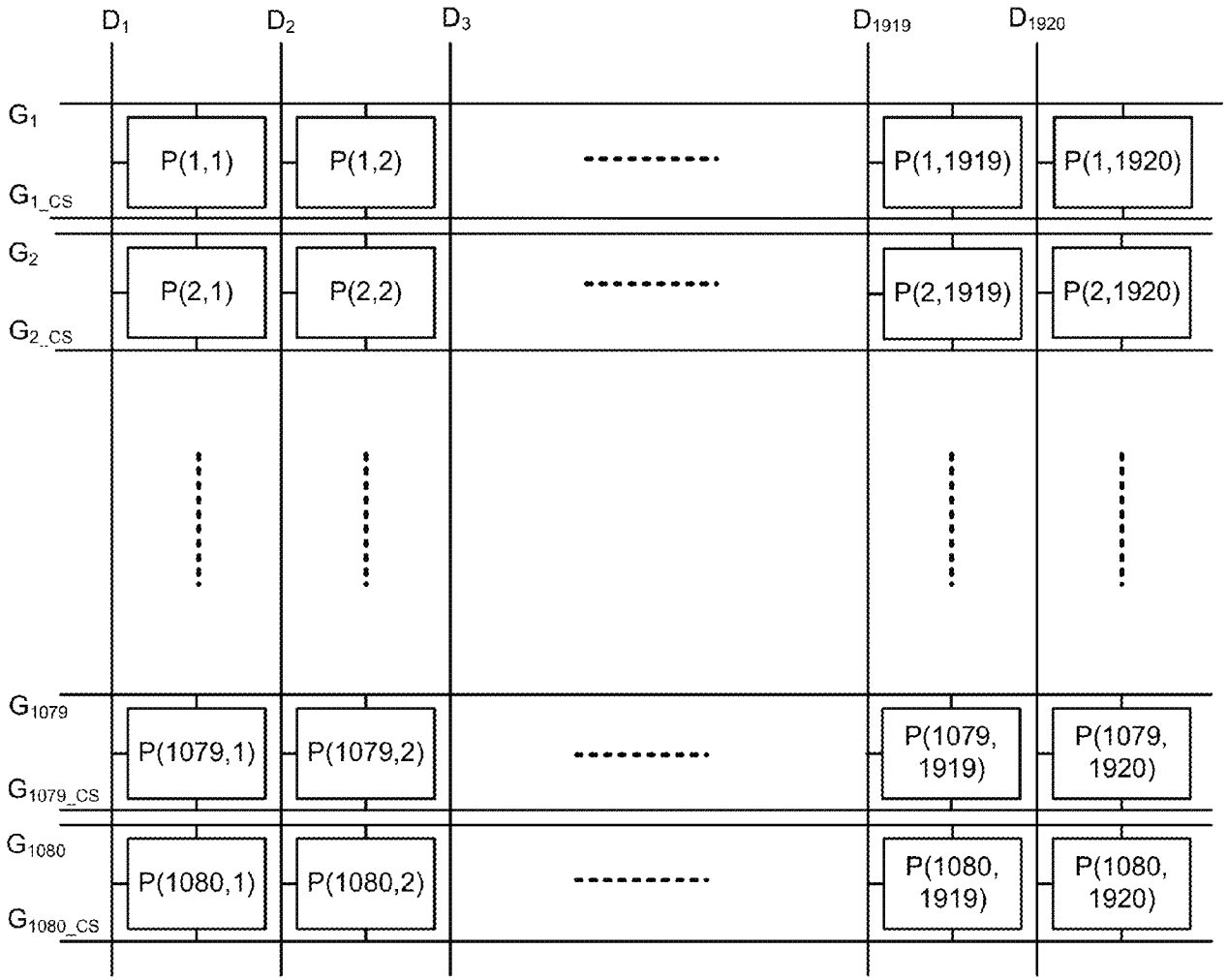
FIG. 5 shows schematically a layout view of an LCD panel according to one embodiment of the present invention.
Figure 6:
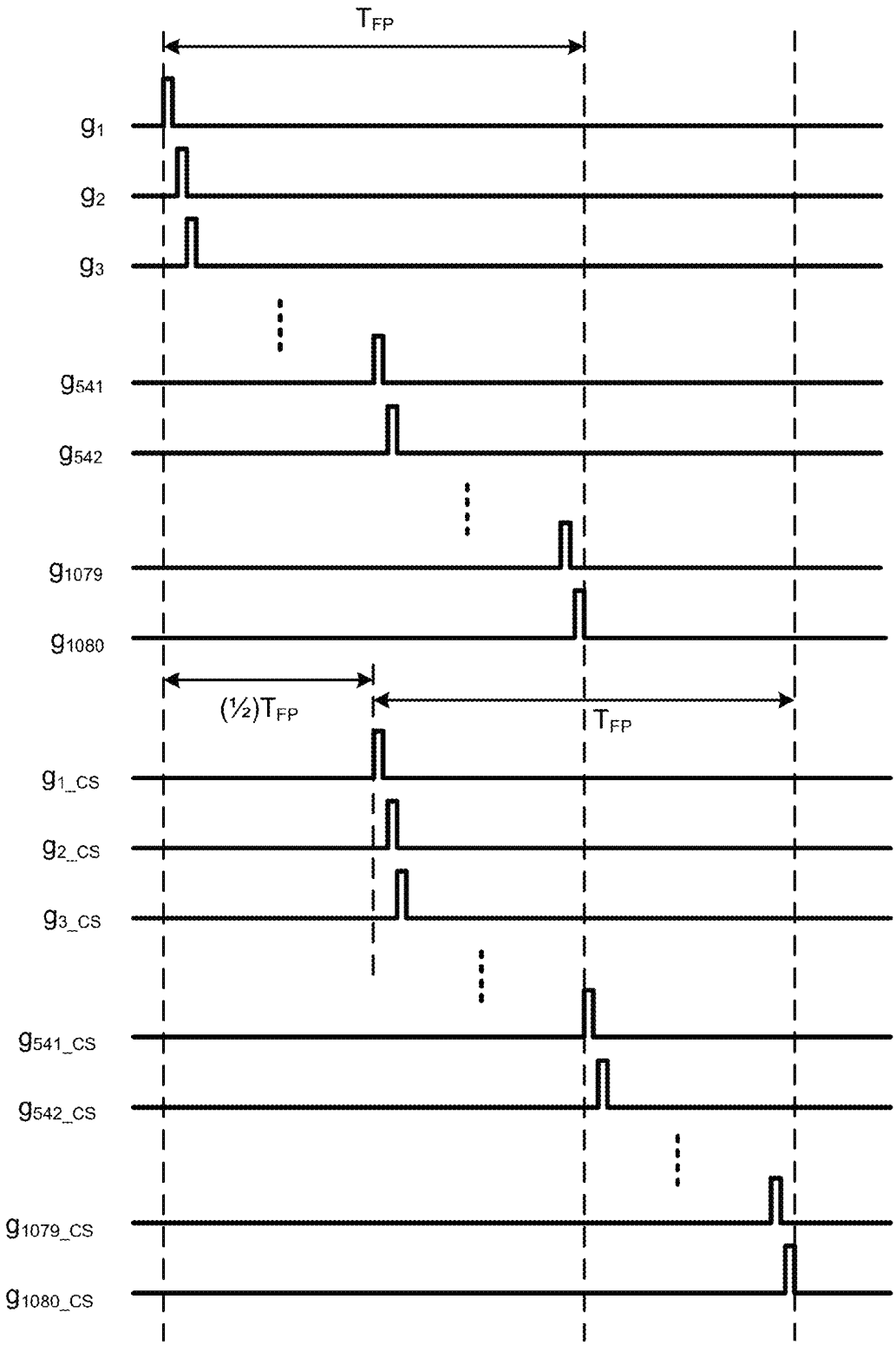
FIG. 6 shows schematically waveform charts of driving signals applied to an LCD panel according to one embodiment of the present invention.

FIGS. 5 and 6 show schematically a layout view of a full HD LCD panel (1080×1920) and waveform charts of 1080 pairs of scanning signals $\{g_n, g_{n_CS}\}$ applied to the LCD panel according to one embodiment of the present invention. The pixel structures are disclosed above and shown in FIGS. 1 and 4. Each scanning signal $g_{n_CS}$ is delayed from the scanning signal $g_n$ by an half of the frame period, $T_{FP}/2$. That is the time sequence of the scanning signals $\{g_{n_CS}\}$ starts from the scanning time of the gate $G_{541}$. Accordingly, the pixel electrode of each pixel P(n,m) is charged to a first voltage $V_1(n,m)$ at the first duration of a frame period, $T_{FP}$, and a second voltage $V_2(n,m)$ at the second duration of the frame period $T_{FP}$, respectively, where the first and second voltages $V_1(n,m)$ and $V_2(n,m)$ are substantially different from each other.

Figure 7:
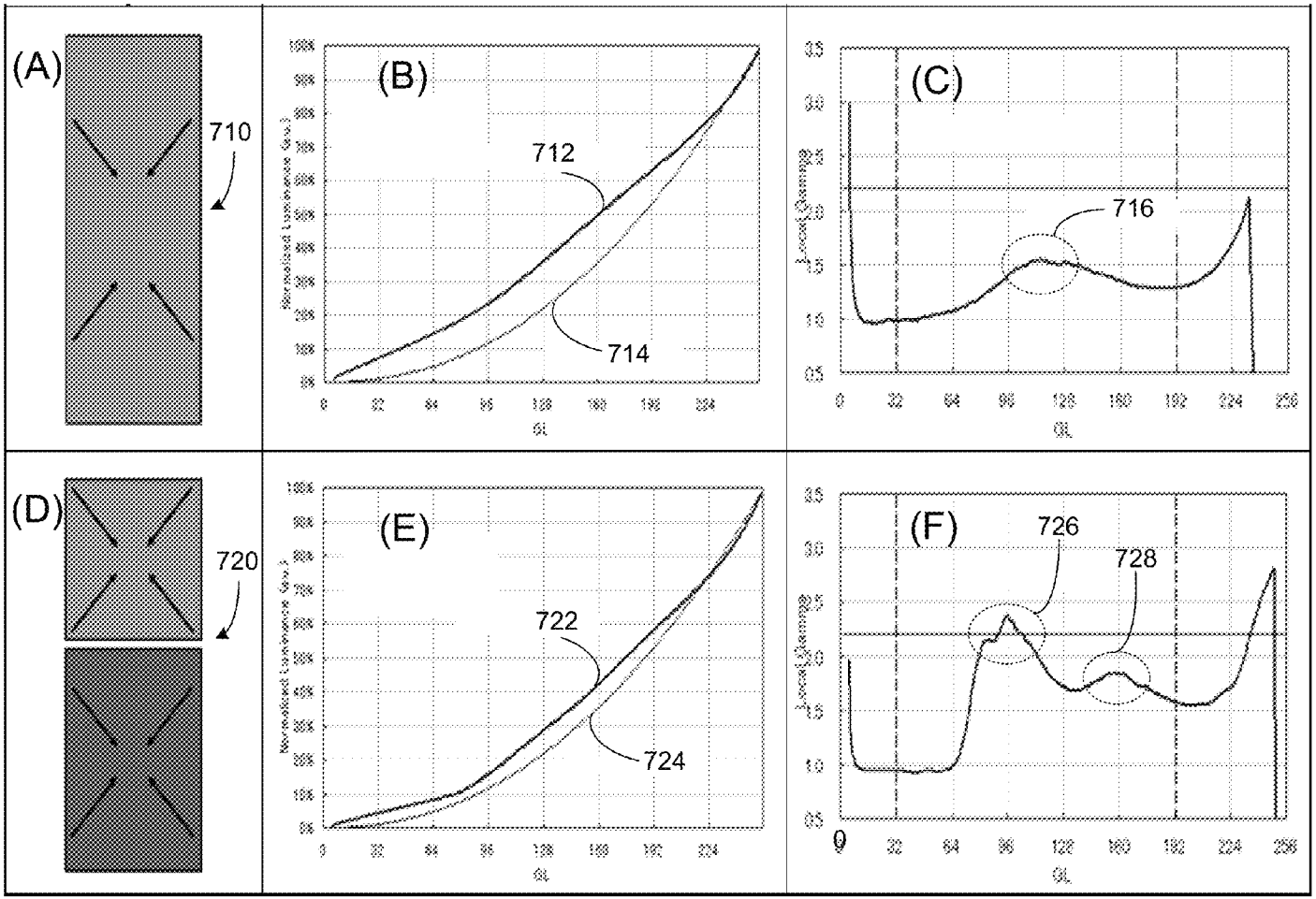
FIG. 7 shows the improvements of the gamma curves and local gammas of the LCD according to embodiments of the present invention: (A) 4 domain pixel layout, (B) the gamma curve for the 4 domain pixel layout, (C) the local gamma for the 4 domain pixel layout, and (D) 8 domain pixel layout, (E) the gamma curve for the 8 domain pixel layout, (F) the local gamma for the 8 domain pixel layout.

FIG. 7 shows the improvement of the gamma curves and local gammas of the LCD according to embodiments of the present invention, (A) 4 domain pixel layout 710 corresponding to the LCD panel shown in FIG. 4, (B) the gamma curves (712 for a new view and 714 for oblique view) for the 4 domain pixel layout, (C) the local gamma (one peak 716) for the 4 domain pixel layout, and (D) 8 domain pixel layout 720 corresponding to the LCD panel shown in FIG. 1, (E) the gamma curves (722 for a new view and 724 for oblique view) for the 8 domain pixel layout, (F) the local gamma (two peaks 726 and 728) for the 8 domain pixel layout. It is clearly shown that the gamma curves of the LCD panel are much close to gamma 2.2.

In another aspect of the present invention, a method of driving an LCD with color washout improvement includes the steps of providing an LCD panel as disclosed above, and applying N pairs of scanning signals $\{g_n, g_{n_CS}\}$ to the N pairs of scanning lines $\{G_n, G_{n_CS}\}$ and a plurality of data signals to the M data lines $\{D_m\}$, respectively, so as to cause the pixel electrode of each pixel P(n,m) to have a first voltage $V_1(n,m)$ at the first duration of a frame period, $T_{FP}$, and a second voltage $V_2(n,m)$ at the second duration of the frame period $T_{FP}$, respectively, where the first and second voltages $V_1(n,m)$ and $V_2(n,m)$ are substantially different from each other.

The N pairs of scanning signals $\{g_n, g_{n_CS}\}$ are configured such that each scanning signal $g_{n_CS}$ is delayed from the scanning signal $g_n$ by time $T_D$, so that the scanning signals $\{g_n\}$ are sequentially applied to the scanning lines $\{G_n\}$ at the first duration of the frame period, and the scanning signals $\{g_{n_CS}\}$ are sequentially applied to the scanning lines $\{G_{n_CS}\}$ at the second duration of the frame period, where the first duration is corresponding to the delayed time $T_D$, where $0.1*T_{FP} \leq T_D \leq 0.9*T_{FP}$.

Briefly, the present invention, among other things, recites an LCD and a method for driving the LCD in which, by utilizing the coupling effect of the first coupling capacitor Cx1, different voltages at the pixel electrode can be achieved in each frame of an image display, thereby improving the color washout.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A liquid crystal display (LCD) panel, comprising:

a plurality of pixels, {P(n,m)}, spatially arranged in the form of a matrix, n=1, 2, . . ., N, and m=1, 2, . . ., M, each pixel P(n,m) defined between a respective pair of scanning lines $(G_n, G_{n_CS})$ and two neighboring data lines $D_m$ and $D_{m+1}$ crossing the pair of scanning lines $(G_n, G_{n_CS})$, and comprising a pixel electrode, a first transistor, T1, electrically coupled to the scanning lines $G_n$, the data line $D_m$ and the pixel electrode, and a second transistor, T2, electrically coupled to the scanning lines $G_{n_CS}$ and the pixel electrode, wherein the pixel electrode comprises a main pixel electrode and a sub-pixel electrode, wherein in operation, a pair of scanning signals $(g_n, g_{n_CS})$ is applied to the pair of scanning lines $(G_{n,}\ G_{n_CS})$ to sequentially turn on the first and second transistors T1 and T2, a data signal is applied to the data line $D_m$ to charge the pixel electrode, wherein the scanning signal $g_{n_CS}$ is delayed from the scanning signal $g_n$ by time $T_D$, so that the pixel electrode of the pixel P(n,m) has a first voltage $V_1(n,m)$ at the time t when the first transistor T1 is turned on and a second voltage $V_2(n,m)$ at the time $(t+T_D)$ when the second transistor T2 is turned on, respectively, wherein each pixel P(n,m) further comprises:

a first liquid crystal (LC) capacitor, Clc1, and a first storage capacitor, Cst1, both electrically connected between the main pixel electrode and a common electrode in parallel;

a second LC capacitor, C1c2, and a second storage capacitor, Cst2, both electrically connected between the sub-pixel electrode and the common electrode in parallel;

a third transistor T3 having a gate electrically connected to the scanning line $G_n$, a source electrically connected to the data lines $D_m$ and a drain; and a first coupling capacitor Cx1 electrically connected between the sub-pixel electrode and the drain of the third transistor T3, wherein the first transistor T1 has a gate electrically connected to the scanning line $G_n$, a source electrically connected to the data lines $D_m$ and a drain electrically connected to the main pixel electrode, and wherein the second transistor T2 has a gate electrically connected to the scanning line $G_{n_CS}$, a source electrically connected to the drain of the third transistor T3 and a drain electrically connected to the sub-pixel electrode.

2. The LCD panel of claim 1, wherein $0.1*T_{FP} < T_D < 0.9*T_{FP}$, $T_{FP}$ being a frame period.

3. The LCD panel of claim 1, wherein each pixel P(n,m) further comprises a second coupling capacitor Cx2 electrically connected between the main pixel electrode and the drain of the third transistor T3.

4. The LCD panel of claim 1, wherein each pixel P(n,m) further comprises a third coupling capacitor Cx3 electrically connected between the main pixel electrode and the sub-pixel electrode.

5. The LCD panel of claim 1, wherein the first voltage $V_1(n,m)$ of the pixel electrode comprises a voltage $V_{1_main}(n,m)$ of the main pixel electrode, and a voltage $V_{1_sub}(n,m)$ of the sub-pixel electrode, and the second voltage $V_2(n,m)$ of the pixel electrode is characterized with a voltage $V_{2_main}(n,m)$ of the main pixel electrode, and a voltage $V_{2_sub}(n,m)$ of the sub-pixel electrode.

6. The LCD panel of claim 5, wherein $V_{1_main}(n,m)$ is corresponding to a data signal applied to the pixel P(n,m).

7. The LCD panel of claim 6, wherein $V_{1_main}(n,m)=V_{gamma}(n,m)$, $V_{1_sub}(n,m)=R1*V_{gamma}(n,m)$, and $V_{2_sub}(n,m)=R2*V_{gamma}(n,m)$, wherein $V_{gamma}(n,m)$ is a gray level voltage being associated with one frame of an image to be displayed on the pixel P(n,m), $0.5<R1<0.95$, and $0.5<R2<0.95$, R1 and R2 being voltage coupling ratios.

8. A method of driving a liquid crystal display (LCD) with color washout improvement, comprising the steps of:

(a) providing an LCD panel comprising a plurality of pixels, {P(n,m)}, spatially arranged in the form of a matrix, n=1, 2, . . ., N, and m=1, 2, . . ., M, each pixel P(n,m) defined between a respective pair of scanning lines ($G_n$, $G_{n_CS}$) and two neighboring data lines $D_m$ and $D_{m+1}$ crossing the pair of scanning lines ($G_n$,$G_{n_CS}$), and comprising a pixel electrode, a first transistor, T1, electrically coupled to the scanning lines $G_n$, the data line $D_m$ and the pixel electrode, and a second transistor, T2, electrically coupled to the scanning lines $G_{n_CS}$ and the pixel electrode, wherein the pixel electrode comprises a main pixel electrode and a sub-pixel electrode; and (b) applying N pairs of scanning signals {$g_n$, $g_{n_CS}$} to the N pairs of scanning lines {$G_n$, $G_{n_CS}$} and a plurality of data signals to the M data lines {$D_m$}, respectively, so as to cause the pixel electrode of each pixel P(n,m) to have a first voltage $V_1(n,m)$ at the first duration of a frame period, $T_{FP}$, and a second voltage $V_2(n,m)$ at the second duration of the frame period $T_{FP}$, respectively, wherein the first and second voltages $V_1(n,m)$ and $V_2(n,m)$ are substantially different from each other, wherein each pixel P(n,m) further comprises:

a first liquid crystal (LC) capacitor, Clc1, and a first storage capacitor, Cst1, both electrically connected between the main pixel electrode and a common electrode in parallel;

a second LC capacitor, C1c2, and a second storage capacitor, Cst2, both electrically connected between the sub-pixel electrode and the common electrode in parallel;

a third transistor T3 having a gate electrically connected to the scanning line $G_n$, a source electrically connected to the data lines $D_m$ and a drain; and a first coupling capacitor Cx1 electrically connected between the sub-pixel electrode and the drain of the third transistor T3, wherein the first transistor T1 has a gate electrically connected to the scanning line $G_n$, a source electrically connected to the data lines $D_m$ and a drain electrically connected to the main pixel electrode, and wherein the second transistor T2 has a gate electrically connected to the scanning line $G_{n_CS}$, a source electrically connected to the drain of the third transistor T3 and a drain electrically connected to the sub-pixel electrode.

9. The method of claim 8, wherein the N pairs of scanning signals {$g_n$, $g_{n_CS}$} are configured such that each scanning signal $g_{n_CS}$ is delayed from the scanning signal $g_n$by time $T_D$, so that the scanning signals {$g_n$} are sequentially applied to the scanning lines {$G_n$} at the first duration of the frame period, and the scanning signals {$g_{n_CS}$} are sequentially applied to the scanning lines {$G_{n_CS}$} at the second duration of the frame period, wherein the first duration is corresponding to the delayed time $T_D$.

10. The method of claim 9, wherein $0.1*T_{FP}<T_D<0.9*T_{FP}$.

11. The method of claim 8, wherein each pixel P(n,m) further comprises a second coupling capacitor Cx2 electrically connected between the main pixel electrode and the drain of the third transistor T3.

12. The method of claim 8, wherein each pixel P(n,m) further comprises a third coupling capacitor Cx3 electrically connected between the main pixel electrode and the sub-pixel electrode.

13. The method of claim 8, wherein the first voltage $V_1(n,m)$ of the pixel electrode comprises a voltage $V_{1_main}(n,m)$ of the main pixel electrode, and a voltage $V_{1_sub}(n,m)$ of the sub-pixel electrode, and the second voltage $V_2(n,m)$ of the pixel electrode is characterized with a voltage $V_{2_main}(n,m)$ of the main pixel electrode, and a voltage $V_{2_sub}(n,m)$ of the sub-pixel electrode.

14. The method of claim 13, wherein $V_{1_main}(n,m)$ is corresponding to a data signal applied to the pixel P(n,m).

15. The method of claim 14, wherein $V_{1_main}(n,m) = V_{gamma}(n,m)$, $V_{1_sub}(n,m)=Rl*V_{gamma}(n,m)$, and $V_{2_sub}(n,m)=R2*V_{gamma}(n,m)$, wherein $V_{gamma}(n,m)$ is a gray level voltage being associated with one frame of an image to be displayed on the pixel P(n,m), $0.5<R1<0.95$, and $0.5<R2<0.95$, R1 and R2 being voltage coupling ratios.

* * * * *